US007602125B2

(12) United States Patent
Hur et al.

(10) Patent No.: US 7,602,125 B2
(45) Date of Patent: Oct. 13, 2009

(54) PLASMA DISPLAY PANEL PROVIDED WITH DIELECTRIC LAYER HAVING A VARIATION IN THICKNESS IN RELATION TO SURFACES OF A DISPLAY ELECTRODE

(75) Inventors: Min Hur, Suwon-si (KR); Young-Do Choi, Suwon-si (KR); Takahisa Mizuta, Suwon-si (KR); Jun-Yong Park, Suwon-si (KR); Su-Bin Song, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 524 days.

(21) Appl. No.: 11/138,308

(22) Filed: May 27, 2005

(65) Prior Publication Data

US 2005/0264203 A1 Dec. 1, 2005

(30) Foreign Application Priority Data

May 31, 2004 (KR) ..... 10-2004-0038944

(51) Int. Cl.
*H01J 17/49* (2006.01)

(52) U.S. Cl. ..... 313/586; 313/582; 313/587

(58) Field of Classification Search ..... 313/582–587
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
6,262,532 B1 * 7/2001 Park et al. ..... 313/585

(Continued)

FOREIGN PATENT DOCUMENTS

CN 1442874 9/2003

(Continued)

OTHER PUBLICATIONS

Korean Office Action of the Korean Patent Application No. 2004-0038944, mailed on Apr. 18, 2006.

(Continued)

*Primary Examiner*—Mariceli Santiago
(74) *Attorney, Agent, or Firm*—Robert E. Bushnell, Esq.

(57) ABSTRACT

A plasma display panel comprises: first and second substrates facing each other; a plurality of barrier ribs partitioning a discharge space between the first and second substrates so as to define a plurality of discharge cells; address electrodes extending in parallel with each other and in a predetermined direction; first and second electrodes disposed on the second substrate in a direction intersecting the direction of the address electrodes, the first and second electrodes being separated from the address electrodes, the first and second electrodes being provided in correspondence with each of the discharge cells; and phosphor layers coated on the discharge cells. The first and second electrodes protrude in a direction from the second substrate to the first substrate, and face each other so as to provide a space therebetween.

18 Claims, 10 Drawing Sheets

U.S. PATENT DOCUMENTS

| | | | | |
|---|---|---|---|---|
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,230,380 | B2 * | 6/2007 | Hur et al. | 313/584 |
| 7,239,086 | B2 * | 7/2007 | Yuki et al. | 313/586 |
| 2003/0168977 | A1 * | 9/2003 | Hashikawa | 313/582 |
| 2005/0062422 | A1 * | 3/2005 | Sasaki et al. | 313/587 |
| 2005/0285530 | A1 * | 12/2005 | Yamada et al. | 313/586 |

FOREIGN PATENT DOCUMENTS

| | | | |
|---|---|---|---|
| CN | 1536605 | | 10/2004 |
| EP | 1783800 | A1 * | 9/2007 |
| JP | 02-148645 | | 6/1990 |
| JP | 06260092 | A * | 9/1994 |
| JP | 09-035641 | | 2/1997 |
| JP | 2845183 | | 10/1998 |
| JP | 2917279 | | 4/1999 |
| JP | 2000-331615 | | 11/2000 |
| JP | 2001-043804 | | 2/2001 |
| JP | 2001283737 | A * | 10/2001 |
| JP | 2001-325888 | | 11/2001 |
| JP | 2003-257321 | | 9/2003 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

PLASMA DISPLAY PANEL PROVIDED WITH DIELECTRIC LAYER HAVING A VARIATION IN THICKNESS IN RELATION TO SURFACES OF A DISPLAY ELECTRODE

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 31 May 2004 and there duly assigned Serial No. 10-2004-0038944.

BACKGROUND OF THE INVENTION

1. Technical Field

The present invention relates to a plasma display panel and, more particularly, to a plasma display panel having a discharge cell structure capable of producing a high density display.

2. Related Art

A plasma display panel (herein referred to as "PDP") is a display apparatus using plasma discharge. Vacuum ultraviolet (herein referred to as "VUV") light emitted by the plasma discharge excites phosphor layers, and in turn, the phosphor layers emit visible light. The visible light is used to display images. Recently, the PDP has been implemented as a thin wide screen apparatus having a screen size of 60 inches or more and a thickness of 10 cm or less. In addition, since it is a spontaneous light emitting apparatus such as a cathode ray tube (CRT), the PDP has excellent color reproducibility. In addition, the PDP has no image distortion associated with its viewing angle. Moreover, the PDP can be manufactured by a simpler method than a liquid crystal display (LCD) can, so that the PDP can be produced with a low production cost and a high productivity. Therefore, the PDP is expected to be the next generation of display apparatus for industry and home televisions.

Since the 1970s, various structures of the PDP have been developed. In recent years, a three-electrode surface-discharge type PDP has been widely used. In the three-electrode surface-discharge type PDP, two electrodes including scan and sustain electrodes are disposed on one substrate, and one address electrode is disposed on the other substrate in a direction intersecting the scan and sustain electrodes. The two substrates are separated from each other so as to provide a discharge space. The discharge space is filled with a discharge gas. In general, in the three-electrode surface-discharge type PDP, the presence of a discharge is determined by an address discharge. Specifically, the address discharge is generated as a facing discharge between the scan electrode controlled separately and the address electrode opposite to the scan electrode, and a sustain discharge related to brightness is generated as a surface discharge between the scan and sustain electrodes disposed on the same substrate.

Recently, PDPs having a size of 42 inches with a resolution of XGA (1024×768) have been commercially provided. In addition, there is a need for PDPs having a resolution of Full-HD (High Definition). In order to implement the PDP having a resolution of Full-HD (1920×1080), that is, a high display density, the size of the discharge cells must be greatly reduced.

In the conventional three-electrode surface-discharge type PDP, the reduction in the size of the discharge cell results in a reduction in the length and area of the electrodes. As a result, there are problems with a decrease in discharge efficiency and brightness and with an increase in discharge firing voltage.

Therefore, in order to implement a PDP having a high display density, there is a need for a new discharge structure which is different from the conventional discharge structure, wherein an address discharge is generated as a facing discharge and a sustain discharge is generated as a surface discharge between the display electrodes.

SUMMARY OF THE INVENTION

An object of the present invention is to provide a plasma display panel having a discharge cell structure capable of generating a sustain discharge as a facing discharge between a pair of display electrodes so as to overcome problems resulting from use of a small-sized discharge cell.

According to an aspect of the present invention, a plasma display panel comprises: a first substrate and a second substrate facing each other; a plurality of barrier ribs partitioning a discharge space between the first and second substrate so as to define a plurality of discharge cells; address electrodes extending parallel to each other in a predetermined direction; first and second electrodes disposed on the second substrate in a direction intersecting the direction of the address electrodes, the first and second electrodes being separated from the address electrodes, the first and second electrodes being provided in correspondence with each of the plurality of discharge cells; and phosphor layers coated on the plurality of discharge cells; wherein the first and second electrodes protrude in a direction from the second substrate to the first substrate, and face each other so as to provide a space therebetween.

In accordance with the present invention, the first and second electrodes and the address electrodes are formed in different layers.

In addition, in cross-sections of the first and second electrodes, the height of the cross-sections of the first and second electrodes may be larger than a width thereof. In addition, the first and second electrodes may be implemented by a metallic electrode.

In addition, a first dielectric layer may be formed to cover the address electrode in the second substrate, and a second dielectric layer may be formed to enclose the first and second electrodes disposed on the first dielectric layer.

In addition, the thickness of the second dielectric layer, formed on top surfaces of the first and second electrodes facing the first substrate, may be larger than the thickness of the second dielectric layer, formed on facing side surfaces of the first and second electrodes.

In addition, each of the address electrodes may comprise a bus electrode extending along one edge of a discharge cell of the plurality of discharge cells, and a protrusion electrode protruding from the bus electrode toward the opposite edge of the discharge cell. In addition, the bus electrode may be a metallic electrode, and the protrusion electrode may be a transparent electrode.

The protrusion electrode may have the shape of rectangle. In addition, the protrusion electrode may have a recess portion on an end side, and the recess portion may be formed by providing a protrusion at one or more corners of the protrusion electrode. Furthermore, the recess portion may have the shape of an arc.

In addition, the protrusion electrode may be formed such that the area of the protrusion electrode near the second electrode is larger than that near the first electrode. In addition, the protrusion electrode may be formed such that the area of the protrusion electrode increases gradually in a direction extending from the first electrode to the second electrode. Finally, the protrusion electrode is disposed close to the second electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
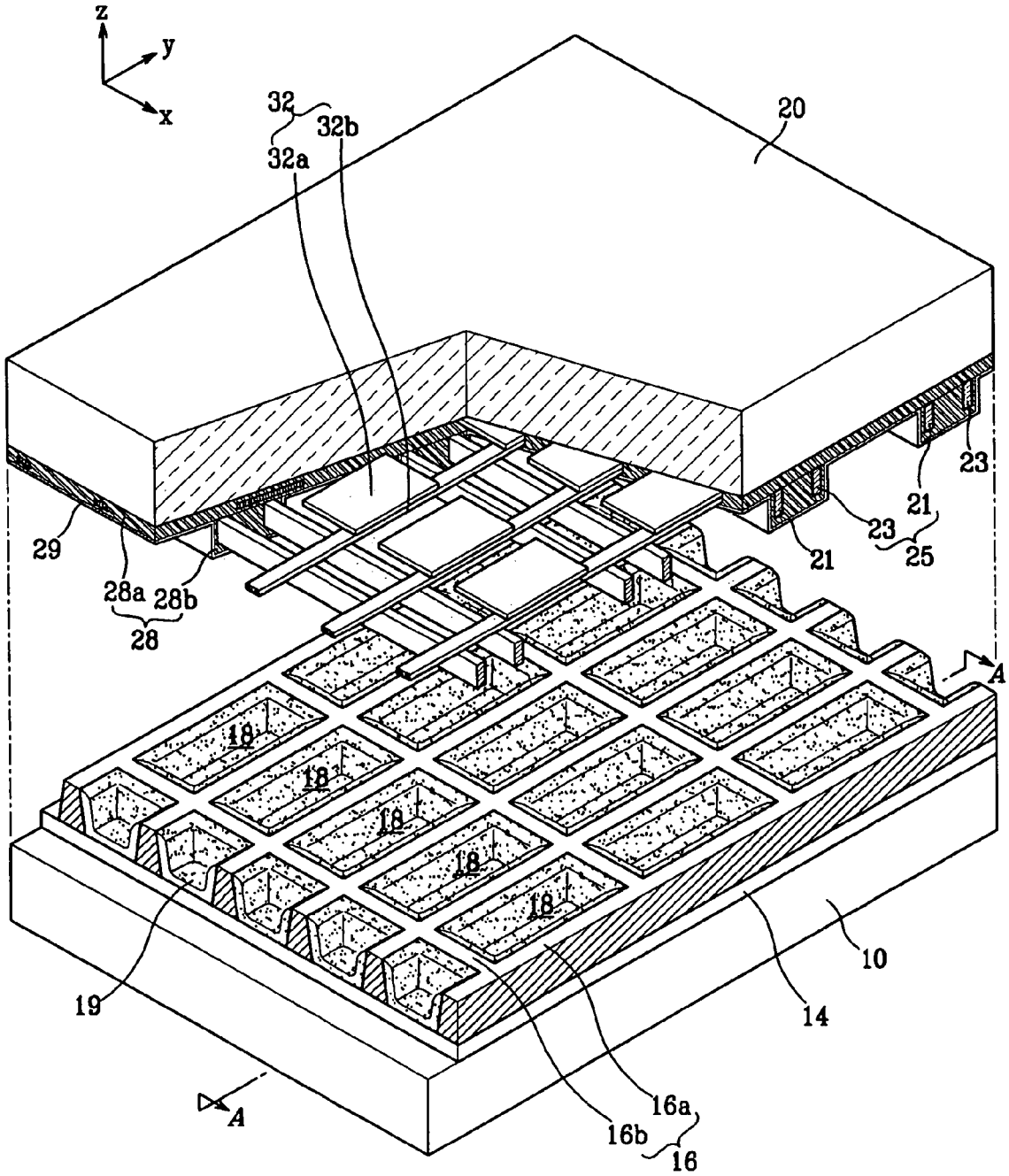
FIG. 1 is a partially exploded perspective view of a plasma display panel (PDP) according to a first embodiment of the present invention.

Embodiments of the present invention will be described in detail with reference to the accompanying drawings. The invention may, however, be embodied in many different forms, and should not be construed as being limited to the embodiments set forth herein. Rather, these embodiments are provided so that this disclosure will be thorough and complete, and will fully convey the concept of the invention to those skilled in the art. Like reference numerals in the drawings denote like elements, and thus their description will be omitted.

Figure 2:
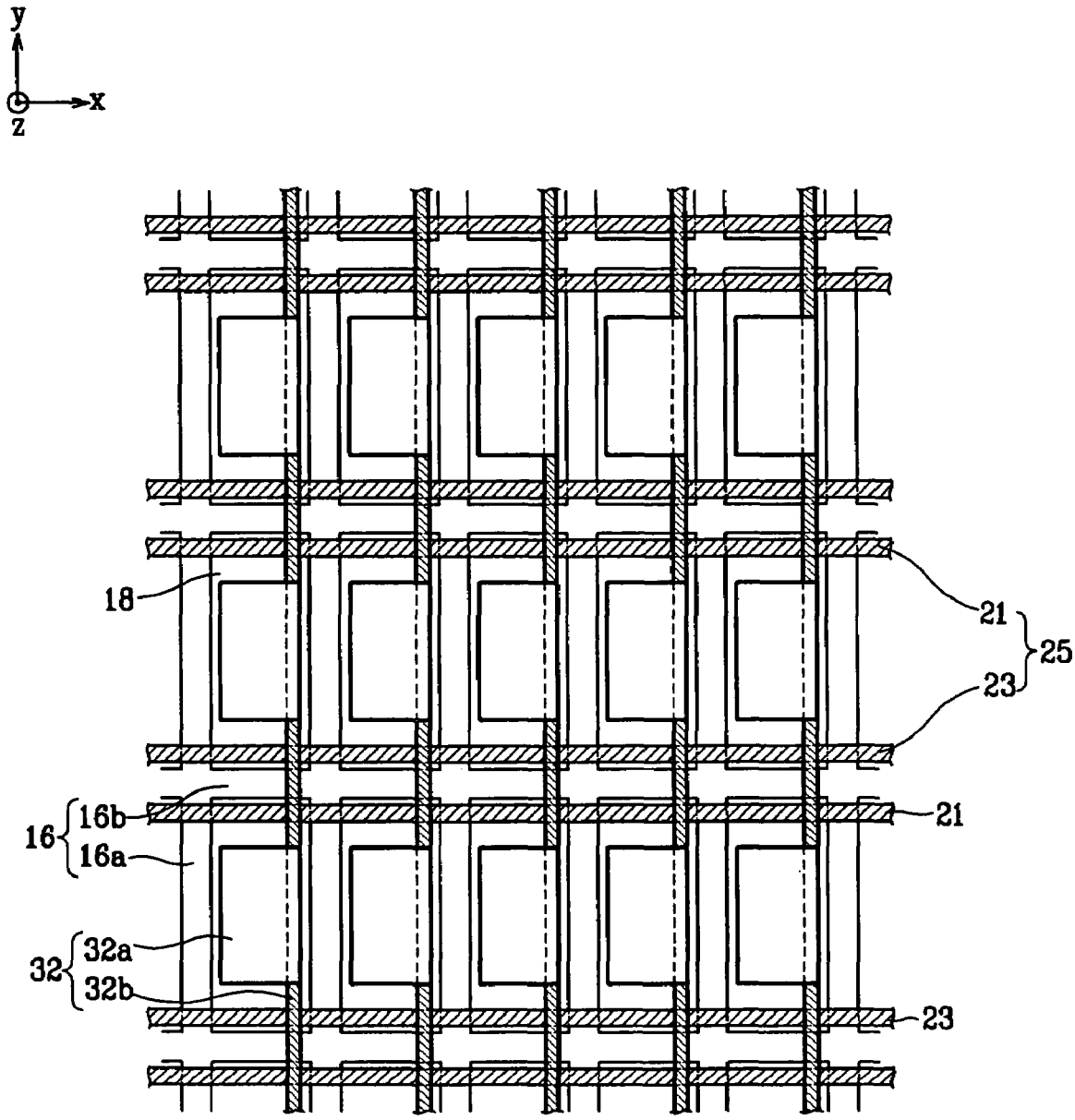
FIG. 2 is a schematic partial plan view showing electrodes and discharge cells of the PDP according to the first embodiment of the present invention.
Figure 3:
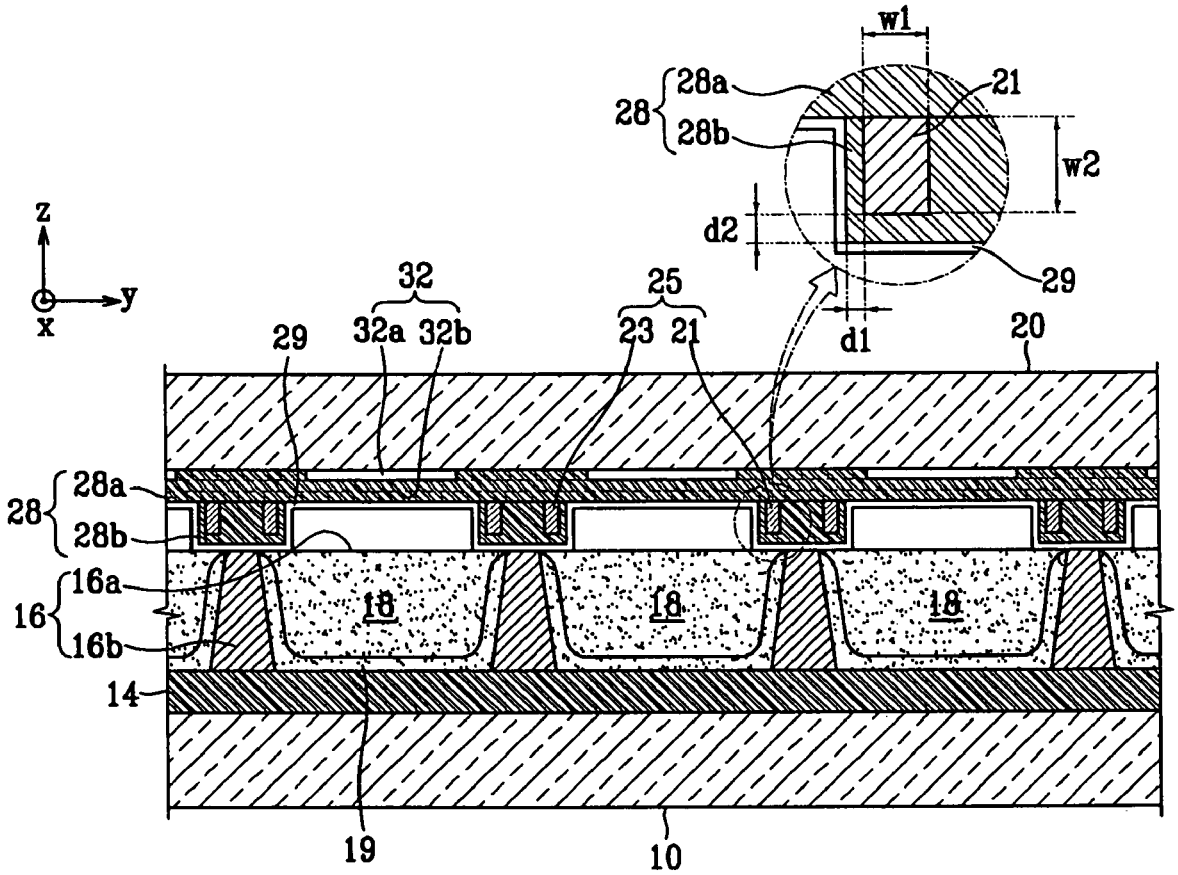
FIG. 3 is a partially exploded cross-sectional view of the assembled PDP taken along line A-A of FIG. 1.

FIG. 1 is a partially exploded perspective view of a plasma display panel according to a first embodiment of the present invention; FIG. 2 is a schematic partial plan view showing electrodes and discharge cells of the plasma display panel according to the first embodiment of the present invention; and FIG. 3 is a partially exploded cross-sectional view of the assembled plasma display panel taken along line A-A of FIG. 1.

As shown in FIG. 1, the plasma display panel according to the present invention includes a first substrate 10 (hereinafter, referred to as a "rear substrate") and a second substrate 20 (hereinafter, referred to as a "front substrate"). The rear substrate 10 and the front substrate 20 face each other. The substrates 10 and 20 are positioned so as to create a discharge space between them. The discharge space is partitioned by barrier ribs 16 so as to define a plurality of discharge cells 18. Phosphor layers 19 are disposed so as to coat sidewalls of the barrier ribs 16 and bottom surfaces of the discharge cells 18. The phosphor layers 19 absorb vacuum ultraviolet (VUV) light, and emit visible light. The discharge cells of the discharge space are filled with a discharge gas. For example, the discharge gas is a mixture of Xe and Ne.

Address electrodes 32 are disposed in parallel with each other on an inner surface of the front substrate 20 in a certain direction (the y direction in the figure). A dielectric layer 28 is disposed on the inner surface of the front substrate 20 so as to cover the address electrodes 32. The address electrodes 32 are separated from each other by a predetermined distance.

Display electrodes 25 are disposed in proximity to the address electrodes 32. The display electrodes 25 are electrically isolated and separated from the address electrodes 32 by a dielectric layer 28.

On the other hand, a dielectric layer 14 is disposed on an inner surface of the rear substrate 10. The barrier ribs 16 are disposed on the dielectric layer 14. Each of the barrier ribs 16 includes first and second barrier rib elements 16*a* and 16*b*. The first barrier rib element 16*a* extends in a direction parallel to the direction of address electrodes 32, and the second barrier rib element 16*b* extends in a direction intersecting the first barrier rib element 16*a*, so that each of the discharge cells 18 is partitioned as an independent discharge space. The barrier rib structure is not limited to the aforementioned structure. For example, a stripe structure wherein longitudinal barrier ribs are disposed in parallel with the address electrodes may be implemented in the present invention. In addition, other barrier rib structures may be implemented in the present invention.

Alternatively, barrier ribs 16 may be directly formed on the inner surface of the rear substrate 10 without a dielectric layer being interposed therebetween.

Referring to FIG. 2, each of the display electrodes 25 includes a first electrode 21 (hereinafter, referred to as a "sustain electrode") and a second electrode 23 (hereinafter, referred to as a "scan electrode"). The sustain electrodes 21 and scan electrodes 23 extend in a direction (the x direction in the figure) intersecting the address electrode 32. The sustain electrodes 21 are used to apply a discharge voltage during a sustain period. The scan electrodes 23 are used to apply discharge voltages in reset, address, and sustain periods. The scan electrodes 23 are involved in all of the discharges of the reset, address, and sustain periods. The sustain electrodes 21 are mainly involved in discharge during the sustain period. The functions of the electrodes vary according to the discharge voltages applied to the electrodes. Therefore, the electrodes are not limited to the aforementioned functions.

In this embodiment, each of the address electrodes 32 includes a protrusion electrode 32*a* and a bus electrode 32*b*. The bus electrode 32*b* extends along one edge of the discharge cell 18. The protrusion electrode 32*a* protrudes from the bus electrode 32*b* toward the opposite edge of the discharge cell 18. The protrusion electrode 32*a* is a transparent electrode made of, for example, indium tin oxide (ITO) in order to increase the aperture ratio of the PDP. The bus electrode 32*b* is preferably a metallic electrode. This may increase the conductivity of the bus electrode 32*b* by compensating for a high resistance of the protrusion electrode 32*a*. As shown in FIG. 3, the protrusion electrode 32*a* has a rectangular shape.

Referring to FIG. 3, in this embodiment, the sustain electrode 21 and the scan electrode 23 protrude in a direction (the z direction in the figure) from the front substrate 20 to the rear substrate 10. In addition, the sustain electrode 21 and the scan electrode 23 face each other so as to define a space therebetween. A facing discharge is generated in the space between the sustain electrode 21 and the scan electrode 23.

In addition, in the cross-section of the sustain electrodes 21 and scan electrodes 23, a height w2 (the z-directional length) of the cross-section of the sustain electrodes 21 and scan electrodes 23 is larger than a width w1 (y-directional length) thereof. Even in the case where the planar size of the discharge cells decreases in order to increase the display density to that of a high density display, it is possible to compensate for the decrease in the planar size of the discharge cells by lengthening the height of the sustain electrodes 21 and scan electrodes 23.

In the embodiment, the sustain electrodes 21, the scan electrodes 23 and the address electrodes 32 are formed in different layers and are electrically isolated by a dielectric layer 28. The dielectric layer 28 includes a first dielectric layer 28*a* and a second dielectric layer 28*b*. The first dielectric layer 28*a* is formed so as to cover the address electrodes 32 in the front substrate 20. The second dielectric layer 28*b* is formed so as to enclose the sustain electrodes 21 and scan electrodes 23, which are the display electrodes 25 disposed on the first dielectric layer 28*a*.

The first dielectric layer 28*a* and second dielectric layer 28*b* may be made of the same material. Preferably, the sustain electrodes 21 and scan electrodes 23 are made of a metallic material.

With respect to the second dielectric layer 28*b* enclosing the sustain electrodes 21 and scan electrodes 23, the thickness d2 of the second dielectric layer 28*b* formed on the top surfaces of the sustain electrodes 21 and scan electrodes 23 facing the rear substrate 10 is larger than the thickness d1 of the second dielectric layer 28*b* formed on the facing side surfaces of the sustain electrodes 21 and scan electrodes 23. By using the structure of the second dielectric layer 28*b*, it is possible to prevent a mis-discharge between electrodes of adjacent discharge cells.

A protective layer 29 made of MgO is disposed so as to cover the first dielectric layer 28*a* and second dielectric layer 28*b* in order to protect the first dielectric layer 28*a* and the second dielectric layer 28*b* from the impact of ions during the plasma discharge. In addition, since it has a high secondary electron emission coefficient with respect to the impacting ions, the protective layer 29 can improve discharge efficiency.

Figure 4:
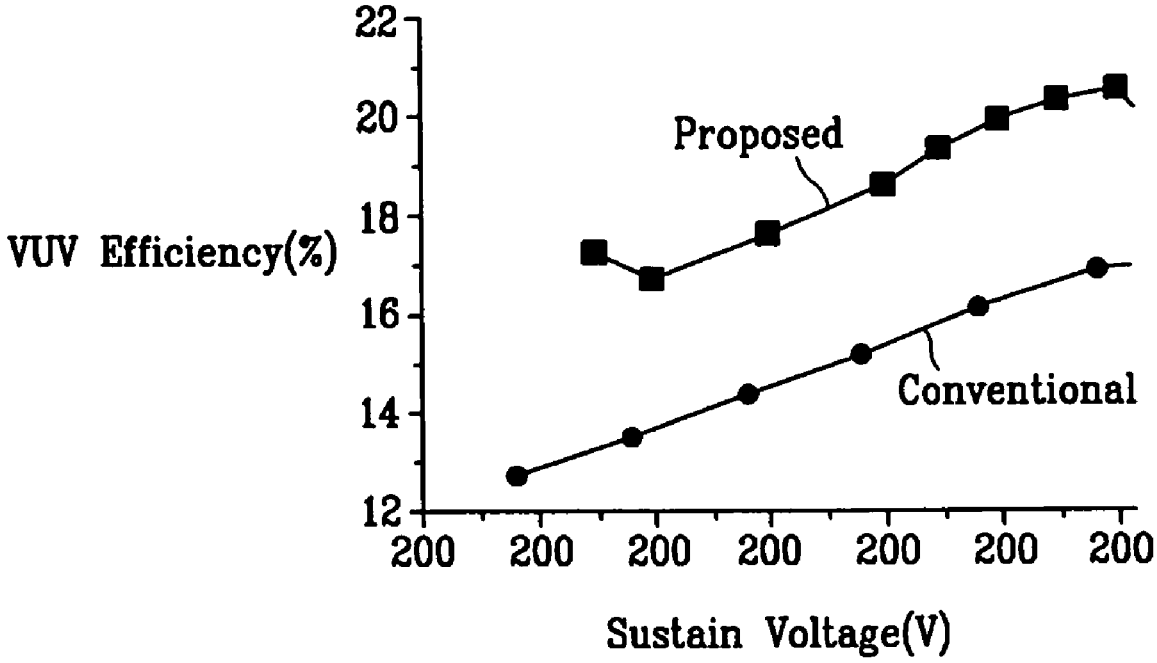
FIG. 4 shows a graph of vacuum ultraviolet (VUV) light efficiency with respect to a discharge sustain voltage in the PDP according to the first embodiment of the present invention and a conventional three-electrode surface-discharge type PDP.

FIG. 4 shows a graph of vacuum ultraviolet (VUV) light efficiency with respect to a discharge sustain voltage in a PDP according to the first embodiment of the present invention and a conventional AC three-electrode surface-discharge type PDP.

In the experiment, a PDP having a size of FULL-HD is used. As shown in the graph, the discharge efficiency (VUV efficiency) of the PDP according to the first embodiment of the present invention increases by 38% in comparison to that of the conventional three-electrode surface-discharge type PDP. In the conventional three-electrode surface-discharge type PDP, discharge electrode pairs are disposed on the front substrate so as to generate surface discharge thereon, and address electrodes are disposed on the rear substrate so as to generate facing discharge between the address and display electrodes.

In the PDP according to the first embodiment of the present invention, all of the electrodes associated with discharge in the discharge cells 18 are disposed on the second substrate 20. Namely, the address electrodes 32 and the display electrodes 25 (sustain electrodes 21 and scan electrodes 23) are disposed on the second substrate 20. As a result, the discharge space partitioned by the barrier ribs 16 can increase. In turn, the area of the coated phosphor layers can increase so that discharge efficiency can be improved. In addition, the associated accumulation of charge on the phosphor layers can prevent shortening of the lifetime of the phosphor layers due to ion sputtering.

In addition, the scan electrodes 23 and address electrodes 32 associated with the address discharge are disposed close to each other, so that the address voltage can be lowered. The facing discharge between the sustain electrodes 21 and scan electrodes 23 results in a high-discharge-efficiency long gap discharge, so that the PDP according to the present invention has a higher discharge efficiency than the conventional surface discharge type PDP. In addition, the PDP according to the present invention can have small-sized discharge cells with high display density, so that it is possible to overcome the problems of the conventional surface discharge type PDP, specifically a decrease in discharge efficiency, a decrease in brightness and an increase in discharge firing voltage.

PDPs according to the second to sixth embodiments of the present invention will be described below. In these embodiments, basic constructions of the PDP are the same as that of the PDP according the first embodiment. Therefore, description of the same construction is omitted. This description will mainly concentrate on the construction of the protrusion electrode of the address electrode according to the second to sixth embodiments.

Figure 5:
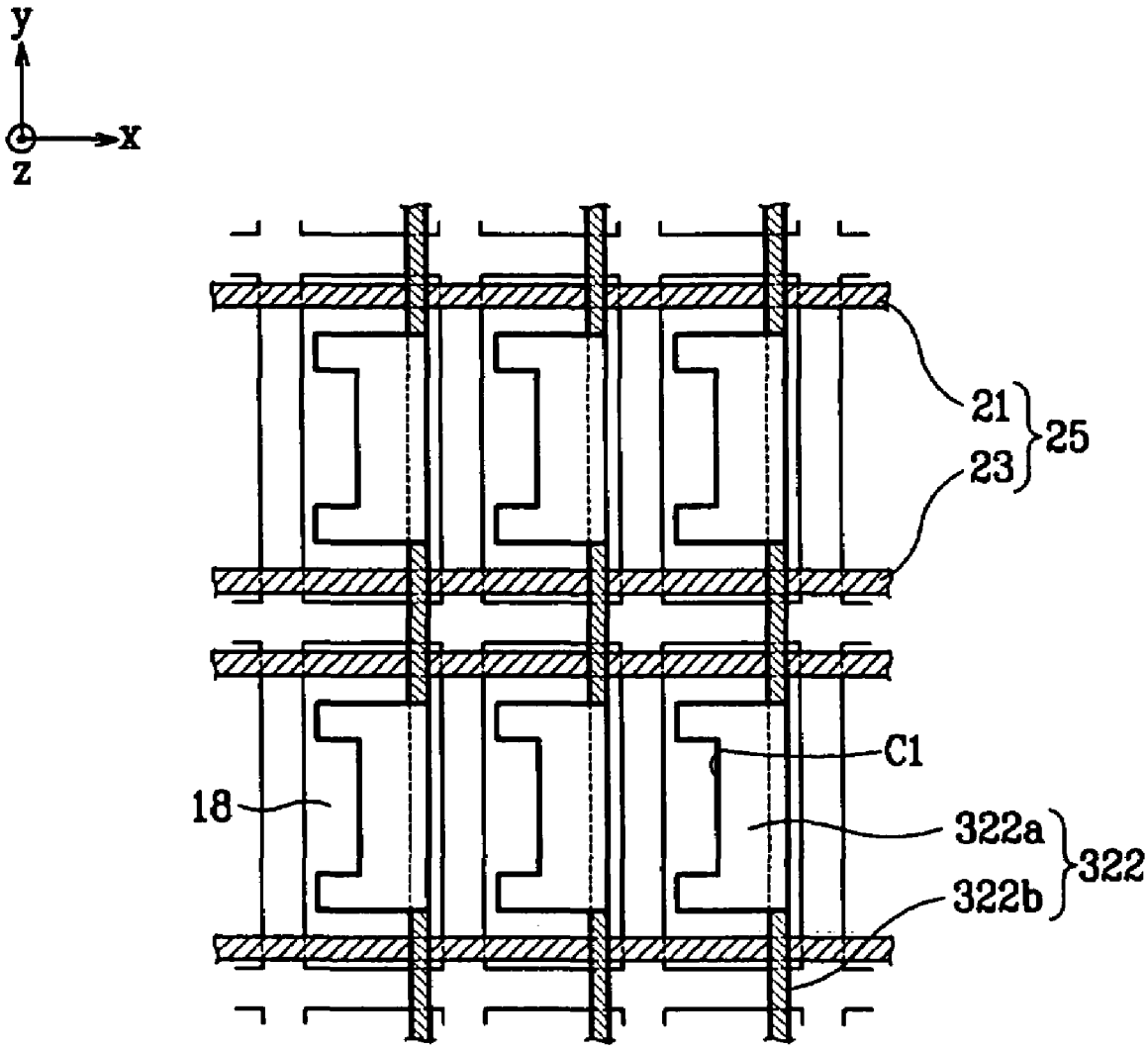
FIG. 5 is a schematic partial plan view showing electrodes of a PDP according to a second embodiment of the present invention.

FIG. 5 is a schematic partial plan view showing electrodes of a PDP according to a second embodiment of the present invention.

In the embodiment, each of the address electrodes 322 includes a bus electrode 322*b* and a protrusion electrode 322*a*. The bus electrode 322*b* extends along one edge of the discharge cell 18. The protrusion electrode 322*a* protrudes from the bus electrode 322*b* toward the opposite edge of the discharge cell 18. The protrusion electrode 322*a* is a transparent electrode made of, for example, indium tin oxide (herein referred to as "ITO") in order to increase the aperture ratio of the PDP. The bus electrode 322*b* is preferably a metallic electrode which increases the conductivity of the bus electrode 322*b* by compensating for high resistance of the protrusion electrode 322*a*. In the embodiment, as shown in FIG. 5, the protrusion electrode 322*a* has a recess portion C1 on an end side. The recess portion C1 is formed by providing two protrusions at the respective corners of the protrusion electrode 322*a*.

Due to the recess portion C1, it is possible to further increase the aperture ratio of the PDP.

Figure 6:
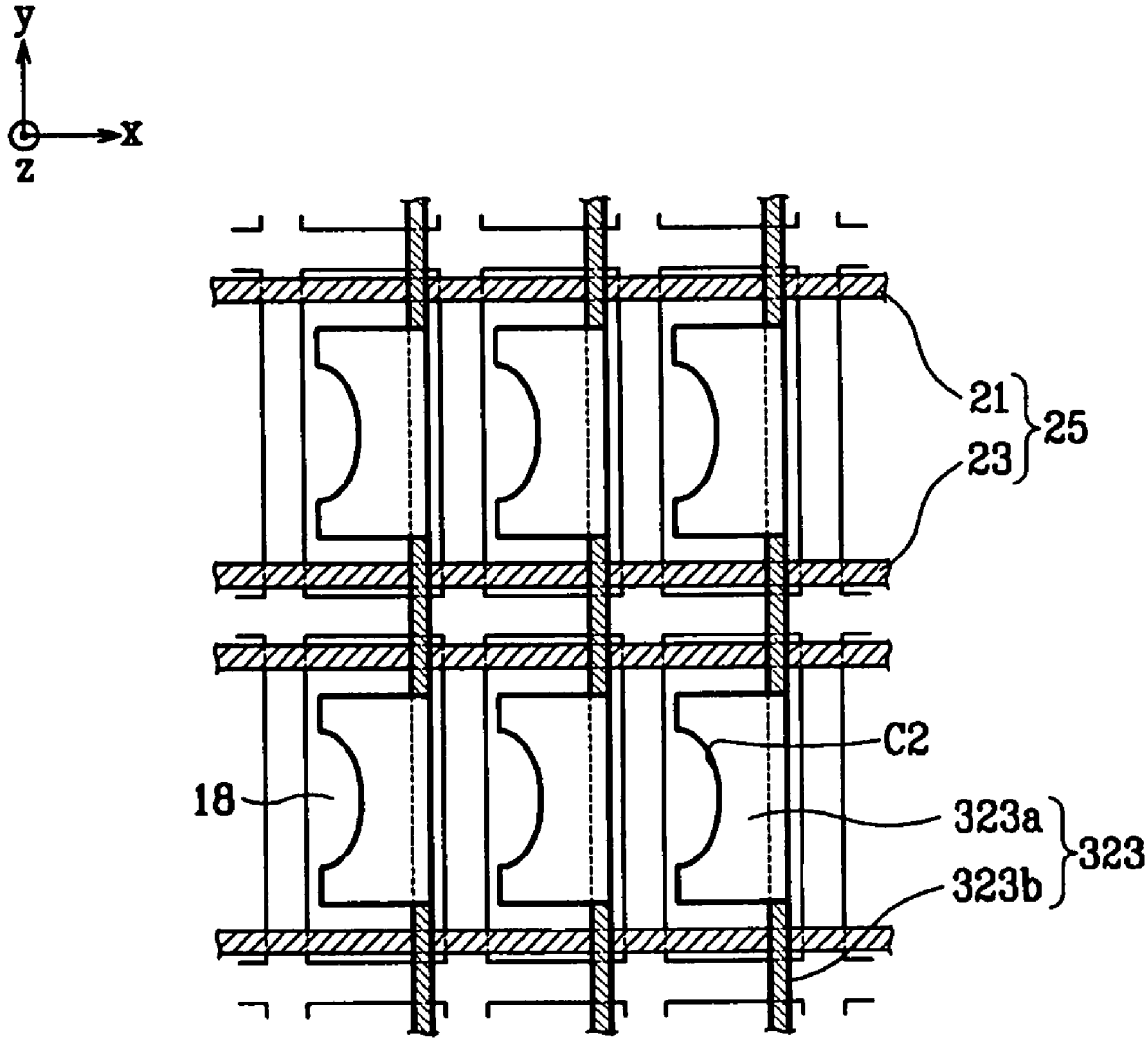
FIG. 6 is a schematic partial plan view showing electrodes of a PDP according to a third embodiment of the present invention.

FIG. 6 is a schematic partial plan view showing electrodes of a PDP according to a third embodiment of the present invention.

In this embodiment, each of the address electrodes 323 includes a bus electrode 323*b* and a protrusion electrode 323*a*. The bus electrode 323*b* extends along one edge of the discharge cell 18. The protrusion electrode 323*a* protrudes from the bus electrode 323*b* toward the opposite edge of the discharge cell 18. The protrusion electrode 323*a* is a transparent electrode made of, for example, ITO in order to increase an aperture ratio of the PDP. The bus electrode 323*b* is preferably a metallic electrode which increases the conductivity of the bus electrode 323*b* by compensating for high resistance of the protrusion electrode 323*a*. In this embodiment, as shown in FIG. 6, the protrusion electrode 323*a* has a recess portion C2 on an end side. The recess portion C2 has the shape of an arc.

Due to the recess portion C2, it is possible to further increase the aperture ratio of the PDP.

Figure 7:
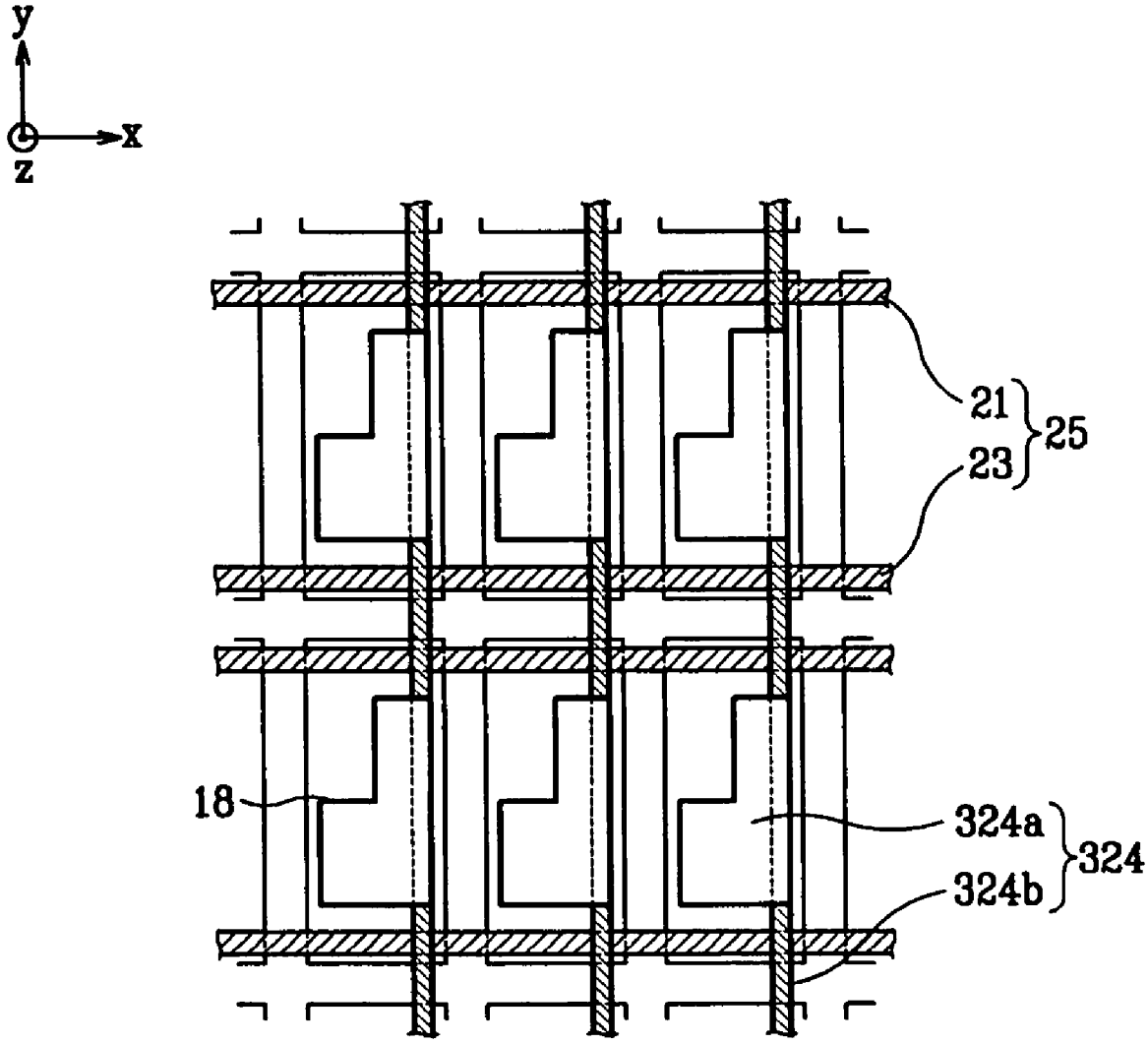
FIG. 7 is a schematic partial plan view showing electrodes of a PDP according to a fourth embodiment of the present invention.

FIG. 7 is a schematic partial plan view showing electrodes of a PDP according to a fourth embodiment of the present invention.

In this embodiment, each of the address electrodes 324 includes a protrusion electrode 324*a* and a bus electrode 324*b*. The bus electrode 324*b* extends along one edge of the discharge cell 18. The protrusion electrode 324*a* protrudes from the bus electrode 324*b* toward the opposite edge of the discharge cell 18. The protrusion electrode 324*a* is a transparent electrode made of, for example, ITO in order to increase the aperture ratio of the PDP. The bus electrode 324*b* is preferably a metallic electrode which increases the conductivity of the bus electrode 324*b* by compensating for a high resistance of the protrusion electrode 324*a*. In this embodiment, as shown in FIG. 7, the protrusion electrode 324*a* is formed such that an area of the protrusion electrode 324*a* near the scan electrode 23 may be larger than the area of the protrusion electrode 324*a* near the sustain electrode 21. Due to the step portion of the protrusion electrode 324*a*, it is possible to decrease the discharge firing voltage across the scan electrode 23 and the address electrode 324 below the discharge firing voltage across the sustain electrode 21 and the address electrode 324.

Figure 8:
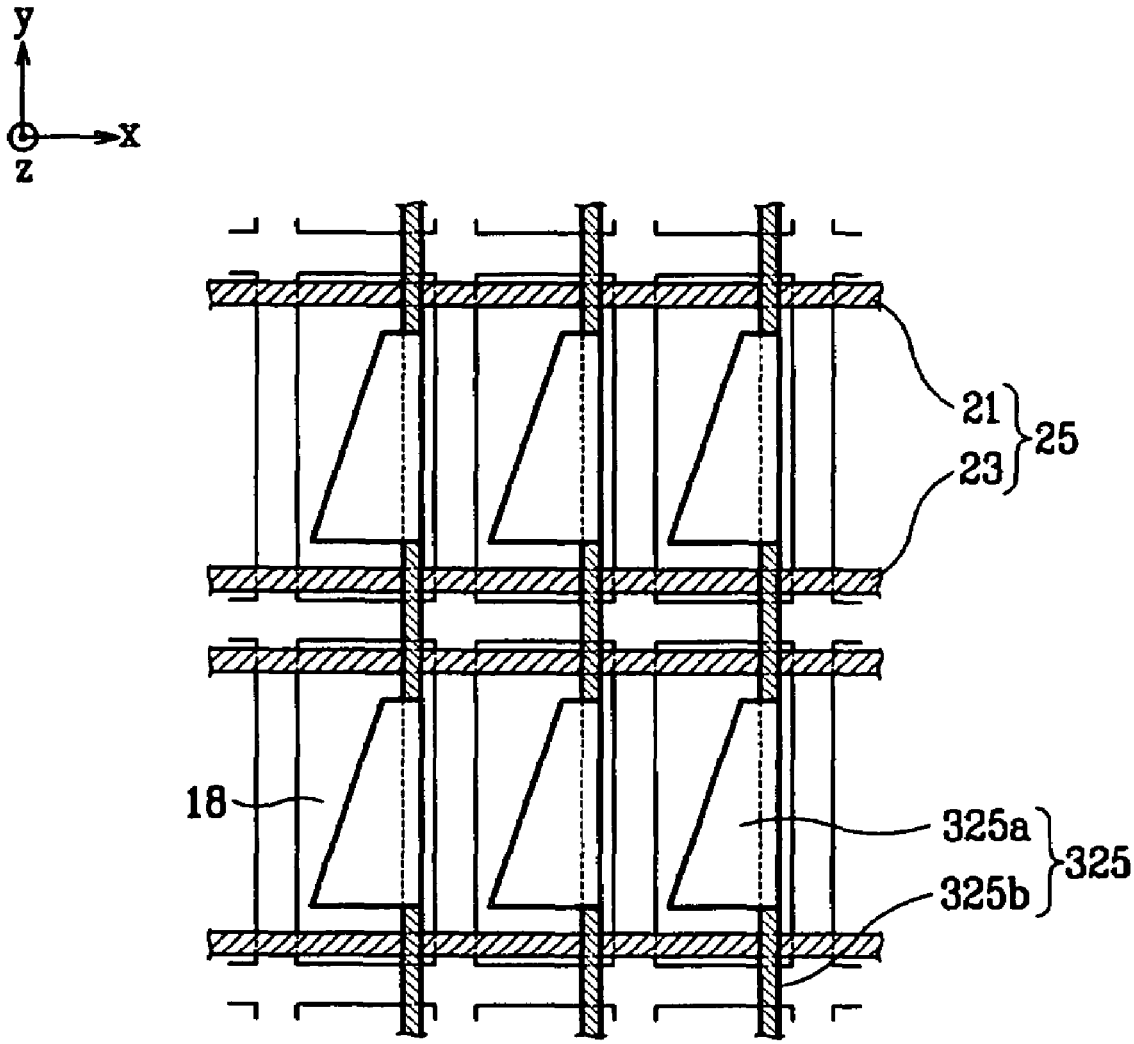
FIG. 8 is a schematic partial plan view showing electrodes of a PDP according to a fifth embodiment of the present invention.

FIG. 8 is a schematic partial plan view showing electrodes of a PDP according to a fifth embodiment of the present invention.

In this embodiment, each of the address electrodes 325 includes a protrusion electrode 325*a* and a bus electrode 325*b*. The bus electrode 325*b* extends along one edge of the discharge cell 18. The protrusion electrode 325*a* protrudes from the bus electrode 325*b* toward the opposite edge of the discharge cell 18. The protrusion electrode 325*a* is a transparent electrode made of, for example, ITO, in order to increase the aperture ratio of the PDP. The bus electrode 325*b* is preferably a metallic electrode which may increase the conductivity of the bus electrode 325*b* by compensating for high resistance of the protrusion electrode 325*a*. In this embodiment, as shown in FIG. 8, the protrusion electrode 325*a* is formed such that the area of the protrusion electrode 325*a* increases gradually in a direction extending from the sustain electrode 21 to the scan electrode 22. Due to the slope portion of the protrusion electrode 325*a*, it is possible to decrease the discharge firing voltage across the scan electrode 23 and the address electrode 325 to a point below the discharge firing voltage across the sustain electrode 21 and the address electrode 325.

Figure 9:
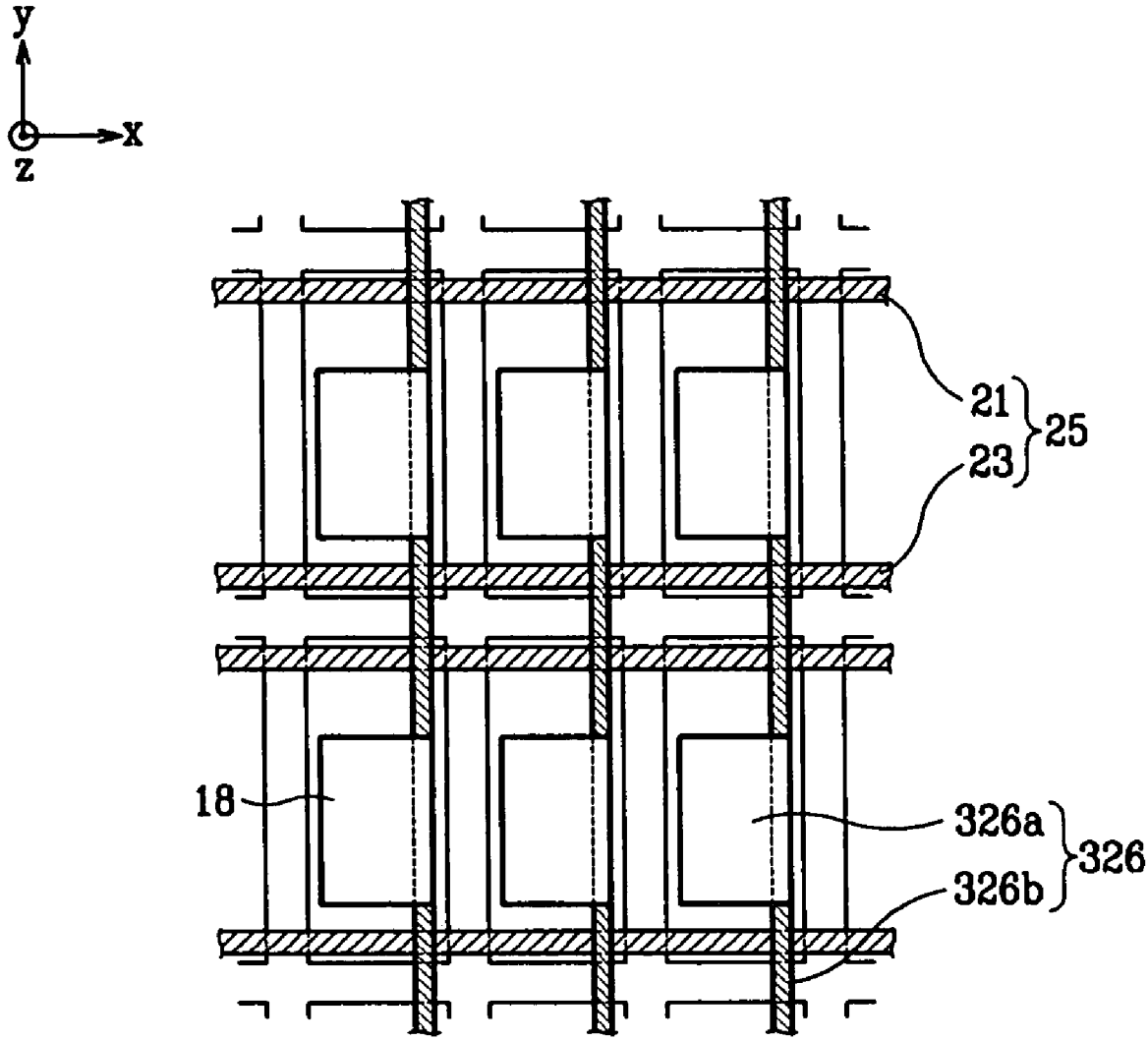
FIG. 9 is a schematic partial plan view showing electrodes of a PDP according to a sixth embodiment of the present invention.

FIG. 9 is a schematic partial plan view showing electrodes of a PDP according to a sixth embodiment of the present invention.

In this embodiment, each of the address electrodes 326 includes a protrusion electrode 326*a* and a bus electrode 326*b*. The bus electrode 326*b* extends along one edge of the discharge cell 18. The protrusion electrode 326*a* protrudes from the bus electrode 326*b* toward the opposite edge of the discharge cell 18. In order to increase the aperture ratio of the PDP, the protrusion electrode 326*a* is a transparent electrode made of, for example, ITO. The bus electrode 326*b* is preferably a metallic electrode which increases the conductivity of the bus electrode 326*b* by compensating for the high resistance of the protrusion electrode 326*a*. This embodiment may include a protrusion electrode 326*a* which has a rectangular shape. In particular, as shown in FIG. 9, the protrusion electrode 326*a* is disposed closer to the scan electrode 23 than it is to the sustain electrode 21. Due to the arrangement of the protrusion electrode 326*a*, it is possible to decrease the discharge firing voltage across the scan electrode 23 and the address electrode 326 to a point below the discharge firing voltage across the sustain electrode 21 and the address electrode 326.

Figure 10:
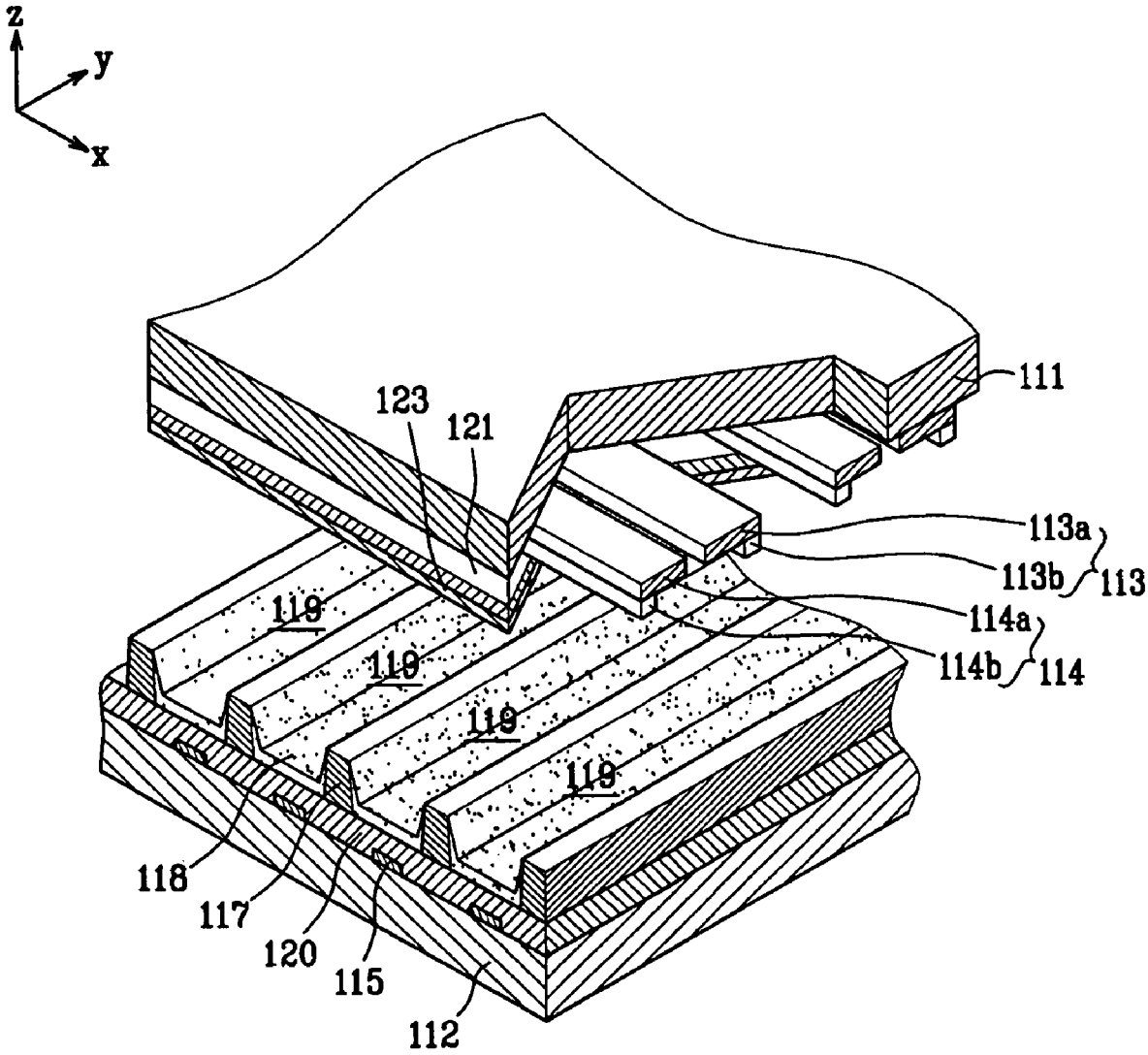
FIG. 10 is a partially exploded perspective view of an AC three-electrode surface-discharge type PDP.

FIG. 10 is a partially exploded perspective view of an AC thee-electrode surface-discharge type PDP. The PDP comprises a front substrate 111 and a rear substrate 112 facing each other. Address electrodes 115 are disposed on an inner surface of the rear substrate 112. A dielectric layer 120 is disposed so as to cover the address electrodes 115. A plurality of barrier ribs 117 is disposed on the dielectric layer 120 so as to define discharge cells 119. The barrier ribs may be disposed in various structures, such as stripe and matrix structures. The stripe structure, wherein longitudinal barrier ribs 117 are disposed parallel to each other, can be constructed by a simple process. The stripe structure has an advantage in an evacuation process. The matrix structure, wherein longitudinal and transverse barrier ribs 117 are disposed, has the advantage of improving discharge efficiency and brightness. Red (R), green (G), and blue (B) phosphor layers are disposed in the respective discharge cells partitioned by the barrier ribs 117.

Pairs of display electrodes 113 and 114 are disposed on an inner surface of the front substrate 111 in a direction intersecting the direction of address electrodes 115. Each pair of display electrodes 113 and 114 comprises transparent electrodes 113 a and 11 4*a*, respectively, and bus electrodes 113*b* and 114*b*, respectively. A dielectric layer 121 and a protective layer 123 made of Magnesium Oxide (MgO) are sequentially stacked on the entire surface of the front substrate 111 so as to cover the display electrodes 113 and 114.

The intersections between the address electrodes 115 of the rear substrate 112 and the pairs of display electrodes 113 and 114 correspond to the discharge cells 119.

In the plasma display panel (PDP) of the present invention, since address electrodes are disposed on a front substrate, it is possible to increase the discharge space partitioned by the barrier ribs. In addition, since the area of the coated phosphor layers can increase, it is possible to improve discharge efficiency. In addition, since charge is accumulated on the phosphor layers, it is possible to prevent shortening of the lifetime of the phosphor layers due to ion sputtering.

In addition, since scan and address electrodes associated with address discharge are disposed close to each other, it is possible to lower the address voltage. In addition, since a facing discharge between the sustain and scan electrodes results in a high-discharge-efficiency long gap discharge, it is possible to obtain a higher discharge efficiency in comparison to the conventional surface discharge type PDP.

In addition, since the PDP according to the present invention can have small-sized discharge cells with high display density, it is possible to overcome the problems of the conventional surface discharge type PDP, specifically, decrease in discharge efficiency, decrease in brightness, and increase in the discharge firing voltage.

Although exemplary embodiments and modified examples of the present invention have been described, the present invention is not limited to the disclosed embodiments and examples, but may be modified so as to appear in various forms without departing from the scope of the appended claims, the detailed description, and the accompanying drawings of the present invention. Therefore, it is natural that such modifications are contained within the scope of the present invention, as defined in the appended claims.

What is claimed is:

1. A plasma display panel, comprising:

a first substrate;

a second substrate positioned to face the first substrate;

a plurality of barrier ribs partitioning a discharge space between the first and second substrates to define a plurality of discharge cells;

address electrodes extending in parallel with each other and in a predetermined direction, and disposed on the second substrate;

a first dielectric layer formed so as to cover the address electrodes;

first and second display electrodes disposed on the first dielectric layer and extending in a direction intersecting the predetermined direction of the address electrodes, the first and second display electrodes being separated from the address electrodes, the first and second display electrodes being provided in correspondence with the plurality of discharge cells;

a second dielectric layer formed so as to enclose the first and second display electrodes; and phosphor layers coated on the plurality of discharge cells;

wherein a thickness of the second dielectric layer formed on top surfaces of the first and second display electrodes facing the first substrate is larger than a thickness of the second dielectric layer formed on facing side surfaces of the first and second display electrodes; and wherein a height of the first and second display electrodes is larger than a width thereof when viewed in a cross-section perpendicular to a direction in which the first and second electrodes extend, whereby the first and second display electrodes face each other within a large area.

2. The plasma display panel of claim 1, wherein the first and second display electrodes and the address electrodes are formed in different layers.

3. The plasma display panel of claim 1, wherein each of the first and second display electrodes comprises a metallic electrode.

4. The plasma display panel of claim 1, wherein each of the address electrodes comprises:

a bus electrode extending along one edge of a discharge cell of the plurality of discharge cells; and a protrusion electrode protruding from the bus electrode toward an opposite edge of the discharge cell.

5. The plasma display panel of claim 4, wherein the bus electrode comprises a metallic electrode.

6. The plasma display panel of claim 4, wherein the protrusion electrode comprises a transparent electrode.

7. The plasma display panel of claim 4, wherein the protrusion electrode has a rectangular shape.

8. The plasma display panel of claim 4, wherein the protrusion electrode has a recess portion on an end side thereof.

9. The plasma display panel of claim 8, wherein the recess portion is formed by providing a protrusion at both corners of the protrusion electrode.

10. The plasma display panel of claim 8, wherein the recess portion has a shape of an arc.

11. The plasma display panel of claim 4, wherein an area of the protrusion electrode near the second display electrode is larger than an area of the protrusion electrode near the first display electrode.

12. The plasma display panel of claim 11, wherein an area of the protrusion electrode increases gradually in a direction extending from the first display electrode to the second display electrode.

13. The plasma display panel of claim 4, wherein the protrusion electrode is disposed close to the second display electrode.

14. A plasma display panel, comprising:

a first substrate;

a second substrate positioned to face the first substrate;

a plurality of barrier ribs partitioning a discharge space between the first and second substrates to define a plurality of discharge cells;

address electrodes extending in parallel with each other and in a predetermined direction on the second substrate;

first and second display electrodes disposed on the second substrate and extending in a direction intersecting the predetermined direction of the address electrodes, the first and second display electrodes being separated from the address electrodes, the first and second display electrodes being provided in correspondence with the plurality of discharge cells; and phosphor layers coated on the plurality of discharge cells;

wherein the first and second display electrodes extend in a direction from the second substrate to the first substrate, and face each other so as to provide a space therebetween;

said plasma display further comprising a first dielectric layer covering the address electrodes and a second dielectric layer enclosing the first and second display electrodes;

wherein a thickness of the second dielectric layer formed on top surfaces of the first and second display electrodes facing the first substrate is larger than a thickness of the second dielectric layer formed on facing side surfaces of the first and second display electrodes; and wherein a height of the first and second display electrodes is larger than a width thereof when viewed in a cross-section perpendicular to a direction in which the first and second electrodes extend, whereby the first and second display electrodes face each other within a large area.

15. The plasma display panel of claim 14, wherein the first and second display electrodes and the address electrodes are formed in different layers.

16. The plasma display panel of claim 14, wherein each of the address electrodes comprises:

a bus electrode extending along one edge of a discharge cell of the plurality of discharge cells; and a protrusion electrode protruding from the bus electrode toward an opposite edge of the discharge cell.

17. The plasma display panel of claim 16, wherein the protrusion electrode has a recess portion on an end side thereof.

18. The plasma display panel of claim 17, wherein the recess portion is formed by providing a protrusion at both corners of the protrusion electrode.

* * * * *